US005820640A

United States Patent [19]

Ikura et al.

[11] Patent Number: 5,820,640

[45] Date of Patent: Oct. 13, 1998

[54] PYROLYSIS LIQUID-IN-DIESEL OIL MICROEMULSIONS

[75] Inventors: Michio Ikura; Siamak Mirmiran, both of Kanata; Maria Stanciulescu, Orleans; Henry Sawatzky, Ottawa, all of Canada

[73] Assignee: Natural Resources Canada, Ottawa, Canada

[21] Appl. No.: 890,405

[22] Filed: Jul. 9, 1997

[51] Int. Cl.[6] ..... C01L 1/00

[52] U.S. Cl. ..... 44/301; 44/307; 44/628

[58] Field of Search ..... 44/300, 301, 307, 44/628

[56] References Cited

U.S. PATENT DOCUMENTS

| | | | |
|---|---|---|---|
| 4,344,770 | 8/1982 | Capener et al. | 44/388 |
| 4,605,422 | 8/1986 | Goddard et al. . | |
| 4,678,860 | 7/1987 | Kuester | 585/14 |
| 4,875,108 | 10/1989 | Minuhin et al. . | |
| 5,203,878 | 4/1993 | Woomer et al. . | |
| 5,380,343 | 1/1995 | Hunter . | |
| 5,478,366 | 12/1995 | Teo et al. . | |
| 5,501,713 | 3/1996 | Wilkins, Jr. . | |
| 5,578,090 | 11/1996 | Bradin | 44/308 |

FOREIGN PATENT DOCUMENTS

| | | |
|---|---|---|
| 2009021 | 1/1990 | Canada . |
| 1283880 | 5/1991 | Canada . |

*Primary Examiner*—Sharon Gibson
*Assistant Examiner*—Cephia D. Toomer

[57] ABSTRACT

A novel diesel engine fuel is in the form of a pyrolysis liquid-in-diesel oil microemulsion fuel comprising: (a) diesel oil in an amount sufficient to form a continuous phase in the composition; (b) a pyrolysis liquid forming a discontinuous phase in the composition, this pyrolysis liquid being a liquid obtained by rapid pyrolysis of biomass; and (c) at least one emulsifier selected from nonionic hydrophilic surfactants with HLB between 4 and 18, derived from fatty acids and polyoxyethylene glycol, or fatty acids, sorbitol and polyoxyethylene or polyethoxylated alcohols with long aliphatic chains. This fuel has excellent stability and physical properties similar to those of regular diesel fuel.

6 Claims, 1 Drawing Sheet

PYROLYSIS LIQUID-IN-DIESEL OIL MICROEMULSIONS

BACKGROUND OF THE INVENTION

The present invention relates to novel engine fuels and, in particular, an extender for diesel fuels.

There is an ongoing interest in finding replacements for fossil fuels and this has been a particular interest in relation to diesel fuels, which are typically not as highly refined as automotive gasolines. For instance, U.S. Pat. No. 5,380,343 describes a diesel fuel which is a microemulsion fuel prepared from about 70–99% alcohol-fatty acid esters, about 1–30% alcohol and less than 1% alkali metal soap. In U.S. Pat. No. 5,203,878 there are described various additive components for diesel oil, including camphor and benzoic acid.

Among various substitutes for diesel oil, consideration has been given by researchers to liquids obtained by the pyrolysis of biomass. Of particular interest are pyrolysis liquids obtained by fast pyrolysis procedures such as described in Berg, Canadian Patent No. 1,283,880, Freel et al, EP 0,513,051 and Scott et al., U.S. Pat. No. No. 4,880,473. Fast pyrolysis is an intense, short duration process that can be carried out in a variety of reaction systems. These systems have the ability to achieve extremely rapid feedstock heating while limiting the reaction to very short times by rapid cooling which stops the chemical reactions before valuable intermediates can degrade to non-reactive, low-value final products. Typical systems for the above process include a fluidized bed or transport reactor. Apparent residence times for volatiles are typically in the range of about 30 ms to 2 seconds, at temperatures in the range of 400°–950° C. Heating rates of the feedstock are typically in the range of 1,000° to 1,000,000° C. per second. The pyrolysis liquids obtained, which have the consistency of crude petroleum oil, are well known in industry and are very different products from the biomass from which they are derived.

These pyrolysis liquids are low in sulphur and combust cleanly. Unfortunately, they are rich in oxygenated functional groups and thus are acidic, hard to ignite and of low calorific values compared with petroleum-based fuel oils. Thus, when these pyrolysis liquids are used in a diesel engine, they tend to corrode the fuel delivery system. Attempts have been made to modify diesel engines to directly use these pyrolysis liquids, but it obviously would be much more satisfactory if the pyrolysis liquids could be modified so that they could be used directly in existing diesel engines without modification to the engines.

It is known that pyrolysis liquids have lower calorific values than regular diesel fuel because of high levels of oxygen originating from trees. This is ordinarily understood to mean reduced engine performance. However, it has been found that when pyrolysis liquids are used as diesel oil substitute, the overall engine performance remains the same because of increased combustion efficiency in the combustion chambers, and particles emission is substantially reduced because of reduced soot formation.

The liquid product obtained from rapid pyrolysis contains a substantial amount of water, acidic components and ash. This liquid is immiscible with regular hydrocarbon based diesel oil.

It is the object of the present invention to develop a suitable blend of a pyrolysis liquid obtained by rapid pyrolysis of biomass with diesel oil that can be used as diesel engine fuel.

SUMMARY OF THE INVENTION

The present invention in its broadest aspect relates to a pyrolysis liquid-in-diesel oil microemulsion fuel comprising:

(a) diesel oil in an amount sufficient to form a continuous phase in the composition;

(b) a pyrolysis liquid forming a discontinuous phase in the composition, this pyrolysis liquid being a liquid obtained by rapid pyrolysis of biomass; and (c) at least one emulsifier selected from nonionic hydrophilic surfactants with HLB between 4 and 18, derived from fatty acids and polyoxyethylene glycol, or fatty acids, sorbitol and polyoxyethylene or polyethoxylated alcohols with long aliphatic chains.

The fuel compositions of the invention may typically contain up to 50% by weight of the pyrolysis liquid together with the diesel oil. The surfactant is usually present in an amount of at least 0.5% and is typically present in amounts in the range of about 0.5 to 5% by weight of the fuel composition.

The pyrolysis liquid used in the composition may be obtained from a wide variety of biomass materials, such as wood waste, cardboard, newsprint, straw, bagasse, agricultural residues, rice husks, etc. In the fast pyrolysis procedure, the biomass is broken down into small particles for use as feedstock and is very rapidly heated for a very short period of time of typically less than two seconds, preferably less than one second, at temperatures in the range of 400°–950° C. A typical rapid pyrolysis liquid has the composition shown in Table 1 below:

TABLE 1

| Major Components | Percent by mass |
|---|---|
| Water | 20–30 |
| Lignin Fragments | 15–20 |
| Aldehydes | 10–20 |
| Carboxylic Acids | 10–15 |
| Carbohydrates | 5–10 |
| Ketones | 1–5 |
| Phenols | 2–5 |
| Alcohols | 2–5 |

The emulsifier for the invention is selected from nonionic hydrophilic surfactants with HLB between 4 and 18, derived from fatty acids and polyoxyethylene glycol, or fatty acids, sorbitol and polyoxyethylene or polyethoxylated alcohols with long aliphatic chains. Examples of these emulsifiers include ethoxylated anhydrosorbitol fatty acid esters, polyoxyethylene glycol fatty acid esters and polyoxyethylene "fatty" alcohol ethers.

DESCRIPTION OF THE PREFERRED EMBODIMENTS BRIEF DESCRIPTION OF THE DRAWINGS

Figure 1:
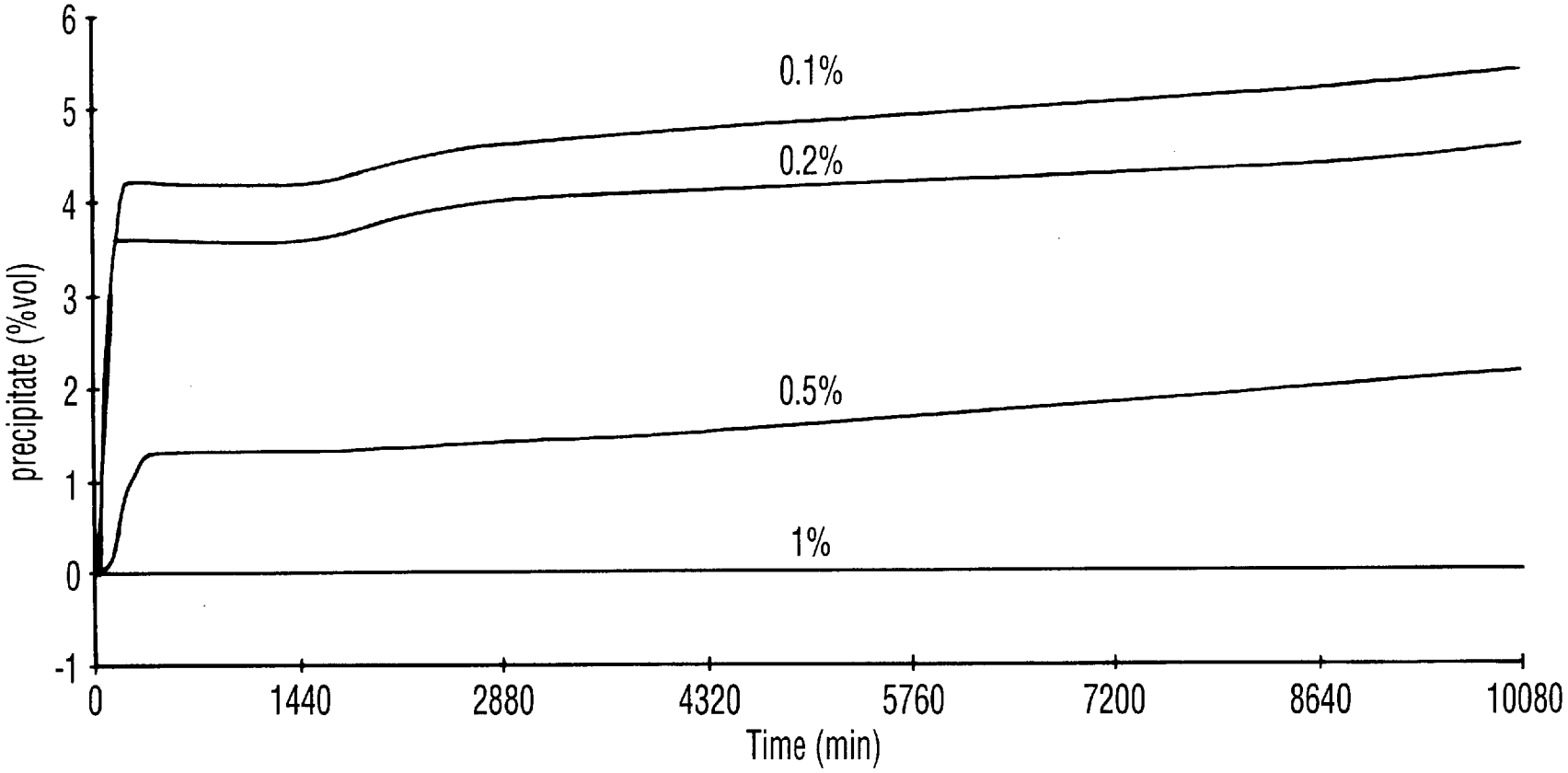

The drawing which illustrates this invention (FIG. 1) is a plot of precipitate formation v. storage time for fuels according to the invention with varying concentrations in percentages by weight of surfactant.

EXAMPLE 1

A pyrolysis liquid was obtained from Ensyn Technologies Inc. of Greely, Ontario which was obtained by rapid pyrolysis of wood feedstocks using a process as described in Freel et al, EP 0,513,051. This liquid, referred to hereinafter as "bio-fuel" had the following characteristics:

TABLE 2

| | |
|---|---|
| Moisture Content (%) | 23.0 |
| Solids Content (%) | 2.6 |
| Dissolved Ash (%) | 0.14 |
| Density (kg/l) | 1.217 |
| Viscosity (cSt) | |
| @ 20° C. | 128 |
| @ 50° C. | 13 |
| Elemental | |
| Carbon | 55.5 |
| Hydrogen | 6.7 |
| Nitrogen | 0.1 |
| Sulphur | 0.0 |
| Oxygen (diff.) | 37.7 |
| Flash Point (°C.) | 66 |
| Pour Point (°C.) | −27 |
| Copper Corrosion | 1a |
| HHV (MJ/kg) | 17.5 |
| pH | 3.4 |

Water-in-oil microemulsions were formulated by mixing diesel oil, the above bio-fuel and surfactants. The surfactants were Hypermer B241 and Hypermer 2296, available from ICI Americas Inc. The microemulsions were produced by adding the surfactants to the bio-fuel and the resulting mixture was then added to the diesel oil during emulsification using a homogenizer, e.g. one from IKA Werke, Jauke & Kunkel GmbH (S50N- G35M Rotor-Stator System). The temperature during mixing was maintained between about 60° and 65° C. and the emulsification was continued until a clear single phase was obtained. Microemulsions prepared are shown in Table 3 below:

TABLE 3

| Microemulsion Fuel Formulations | | | | |
|---|---|---|---|---|
| Bio-Fuel (wt %) | Diesel (wt %) | Hypermer B241 (wt %) | Hypermer 2296 (wt %) | Stability (h) |
| 5 | 93 | 1 | 1 | >2160 |
| 10 | 88 | 1 | 1 | >2160 |
| 20 | 78 | 1 | 1 | >2160 |
| 30 | 68 | 1 | 1 | >2160 |

TABLE 3-continued

| Microemulsion Fuel Formulations | | | | |
|---|---|---|---|---|
| Bio-Fuel (wt %) | Diesel (wt %) | Hypermer B241 (wt %) | Hypermer 2296 (wt %) | Stability (h) |
| 40 | 58 | 1 | 1 | >2160 |
| 20 | 79 | 0.5 | 0.5 | See FIG. 1 |
| 20 | 79.5 | 0.25 | 0.25 | See FIG. 1 |
| 20 | 79.8 | 0.1 | 0.1 | See FIG. 1 |
| 20 | 79.9 | 0.05 | 0.05 | See FIG. 1 |

The main physical properties of the microemulsions of the invention were measured and summarized in Table 4. One of the important specifications is the flash point (closed cup) which must be above 43° C. for No. 2 diesel fuel. It will be seen that the flash points for the microemulsion fuels are all above that of No. 2 diesel fuel and they increase with increasing bio-fuel concentration. The heat of combustion of the microemulsion fuels decreased by about 5% for the addition of every 10% of "bio-fuel" of the invention.

The stability of the microemulsion fuels of the invention is mainly controlled by the amount of surfactants used for emulsification. As shown in FIG. 1, the reduction of surfactants concentration increases the amount of precipitates formed after the bio-fuel of the invention is stored for a long period of time. The precipitates were easily reemulsified upon gently shaking of the mixture. For a microemulsion fuel containing 20% by weight of the bio-fuel, best results were obtained with 0.5% by weight of each of Hypermer B241 and Hypermer 2296, where Hypermer 2296 acts mostly as co-surfactant to facilitate the emulsification.

While the reduction of surfactant concentration reduces processing costs, the reduced surfactant concentration results in unstable emulsions. The reduced surfactants also increases the viscosity of the fuel, resulting in increased power consumption during emulsification.

TABLE 4

| Physical properties of diesel fuel and biodiesel | | | | | | | |
|---|---|---|---|---|---|---|---|
| Parameter | ASTM test | Diesel Fuel Grade 2 | Bio-Oil/Diesel 5 (wt %) | Bio-Oil/Diesel 10 (wt %) | Bio-Oil/Diesel 20 (wt %) | Bio-Oil/Diesel 30 (wt %) | Bio-Oil/Diesel 40 (wt %) |
| Flash Point (open cup) (°C.) | D-92 | 92 | 86 | 86 | 82 | 82 | 90 |
| Flash Point (closed cup) (°C.) | D-93 | 68 | 70 | 71 | 74 | 72 | 75 |
| Fire Point (°C.) | D-92 | 94 | 90 | 94 | 98 | 94 | 98 |
| Heat of Combustion (cal/g) | ISO-1928 | 10738 | 10511 | 10274 | 9754 | 9253 | 8601 |
| Pour Point (°C.) | D-97 | −45 | N/A | −48 | N/A | −48 | N/A |
| Cloud Point (°C.) | D-5773 | −18 | N/A | 23 | N/A | 22 | N/A |
| Corrosion (Cu, 3 h @ 100° C.) | D-130 | 1b | N/A | 1a | N/A | 1a | N/A |
| Ash (% wt) | D-482 | 0 | N/A | 0.02 | N/A | 0.13 | N/A |
| Water & Sediment (% vol) | D-1796 | 0 | N/A | 0.1 | N/A | 0.2 | N/A |

We claim:

1. A pyrolysis liquid-in-diesel oil microemulsion fuel comprising:

(a) diesel oil in an amount sufficient to form a continuous phase in the composition;

(b) a pyrolysis liquid forming a discontinuous phase in the composition, said pyrolysis liquid being a liquid obtained by rapid pyrolysis of biomass; and (c) at least one emulsifier selected from nonionic hydrophilic surfactants with HLB between 4 and 18, derived from fatty acids and polyoxyethylene glycol, or fatty acids, sorbitol and polyoxyethylene or polyethoxylated alcohols with long aliphatic chains.

2. A composition according to claim 1 containing up to 50% by weight of pyrolysis liquid.

3. A composition according to claim 2 containing up to 5% by weight of said surfactant.

4. A composition according to claim 3 containing about 0.5 to 5% by weight of said surfactant.

5. A composition according to claim 3 wherein the pyrolysis liquid is obtained by pyrolysis of biomass at temperatures in the range of 400°–950° C. for less than 2 seconds at atmospheric pressure.

6. A composition according to claim 5 wherein the pyrolysis liquid is obtained from lignocellulosic biomass.

* * * * *